United States Patent [19]

Okada et al.

[11] 4,383,705

[45] May 17, 1983

[54] PRESSURE-SENSITIVE RECORDING MATERIAL

[75] Inventors: Yoshio Okada; Yuriko Igarashi, both of Iwaki; Kimio Okubo, Hoya, all of Japan

[73] Assignee: Kureha Kagaku Kogyo Kabushiki Kaisha, Nihonbashi, Japan

[21] Appl. No.: 249,086

[22] Filed: Mar. 30, 1981

[30] Foreign Application Priority Data

Jan. 13, 1981 [JP] Japan ..... 56-3566

[51] Int. Cl.[3] ..... B41M 5/16; B41M 5/22

[52] U.S. Cl. ..... 282/27.5; 106/308 N; 252/316; 427/150; 428/320.6; 427/151; 428/320.28; 428/537; 428/914

[58] Field of Search ..... 282/27.5; 427/150, 151; 428/307, 323, 411, 537, 914, 402, 320.4, 320.6, 320.8, 327, 488, 913; 106/21, 308 N; 252/316

[56] References Cited

U.S. PATENT DOCUMENTS

| | | | |
|---|---|---|---|
| 3,836,383 | 9/1974 | Kiritani et al. | 282/27.5 |
| 3,936,566 | 2/1976 | Sato et al. | 428/323 |
| 4,289,806 | 9/1981 | Sato et al. | 427/150 |

FOREIGN PATENT DOCUMENTS

| | | | |
|---|---|---|---|
| 48-18270 | 3/1973 | Japan | 282/27.5 |

*Primary Examiner*—Bruce H. Hess

*Attorney, Agent, or Firm*—Wegner & Bretschneider

[57] ABSTRACT

There are provided a solvent for pressure-sensitive recording material, which comprises a mixture of 1-isopropylphenyl-2-phenylethane with diisopropylnaphthalene and/or partially hydrogenated terphenyl, and a pressure-sensitive recording material, a sheet of which is coated with microcapsules containing therein the solvent, showing a sufficient rate of color development and an acceptable color density under severe environmental conditions such as very cold conditions as well as hot and humid conditions.

7 Claims, No Drawings

PRESSURE-SENSITIVE RECORDING MATERIAL

This invention relates to an improved pressure-sensitive recording material, and more in detail, to a pressure-sensitive recording material exhibiting excellent colour development and colour density even under severe environmental conditions.

The pressure-sensitive recording material or paper comprises supporting paper sheet(s), microcapsules containing a solvent including a colourless electron-donator having a property of forming a colour (hereinafter referred to as a colour former) and a colour-developing substance (hereinafter referred to as a colour developer) capable of producing a coloured product by reacting with the colour former. The pressure-sensitive recording paper is, generally, classified into the following three types: (1) a sheet of paper having only one side coated with the microcapsules together with the colour developer in layers or in a mixed state; (2) a combination of a sheet of paper coated with the microcapsules (hereinafter referred to as a CB paper) and a sheet of paper coated with the colour developer (hereinafter referred to as a CF paper); and (3) a combination of a sheet of paper having one side coated with the microcapsules and the other side with the colour developer (hereinafter referred to as a CFB paper) with the CB paper and the CF paper.

When an artificial localized pressure is applied on the pressure-sensitive recording paper, the microcapsules in the pressured area of the paper are broken to bring the colour former into contact to the colour developer in the solvent, thus resulting in the colour exhibition.

The quality of the pressure-sensitive recording paper is, to high degree, influenced mainly by the solvent contained within the microcapsule and the wall material constituting the microcapsule. Although several high polymers have been proposed as the wall material, gelatine has been widely employed at present as the most suitable substance for the wall material.

Recently, the use of the pressure-sensitive recording paper has come to be propagated more and more throughout the world, and even in the climately hot and humid regions and also in the very cold regions.

Accordingly, the opportunity for the pressure-sensitive recording paper to be exposed to severe environmental conditions has been increased.

The term "severe environmental conditions" hereinmentioned means the so-called hot and humid conditions of the ambient temperature of about 40° to 50° C. and of the relative humidity of more than about 80%, or the environmental condition of the ambient temperature of lower than about 0° C.

The case in which the pressure-sensitive recording paper is exposed to the hot and humid conditions may be also seen, for instance, in the storage in a hot and humid warehouse, and the case in which the recording paper is exposed to the severely cold conditions may be seen, for instance, in outdoor facilities such as a gas station in a very cold region.

In the hot and humid conditions, there may be a problem that the solution included in the microcapsules has a tendency to exude to outside of the capsules with a result of causing undesirable colour development before the regular use of the paper and of damaging the paper by contamination to prevent the satisfactory colour development at the time of the regular use.

On the other hand, in the very cold region, there is another fatal problem that it takes a longer period of time for the colour to appear clearly after recording, or the developed colour just after recording is so pale that the expression based on the colour cannot be read.

However, since the pressure-sensitive recording paper has not hitherto been popularized to the extent of frequently exposed to the severe environmental conditions or used under such conditions, there has been no recognition that the pressure-sensitive recording paper should retain the excellent properties even under the severe environmental conditions. Accordingly, reports of research on the pressure-sensitive recording paper capable of retaining its excellent properties even under the severe environmental conditions have not been found.

In view of the present situation, the inventors of the present invention payed special attention to the fact that it is of importance to select the solvent in the microcapsule of gelatine in order to provide a pressure-sensitive recording paper which retains the excellent colour-forming property such as the rapid rate of colour development and the deep colour density, etc. even under the severe environmental conditions.

The features required for the solvent are generally mentioned as follows:

(1) the solubility of colour former in the solvent is high;

(2) the rate of colour development, the colour density and the colour-tone stability are sufficiently high under the solvent;

(3) the solvent is stable against light, heat and chemicals;

(4) the solvent is substantially odorless, and (5) the solvent is low toxic and safe to human.

Diisopropylnaphthalene and partially hydrogenated terphenyl (refer to U.S. Pat. No. 3,968,301) are conventionally employed as the solvent fulfilling the above-mentioned features. In fact, the pressure-sensitive recording paper prepared by using each of the two solvents may be satisfactory developed under ordinary environmental conditions or under the hot and humid environmental conditions. However, the thus prepared pressure-sensitive recording paper has a very slow rate of the colour development and a poor colour density just after recording under the environmental conditions of lower than 0° C., especially in the case where the colour developer is synthetic one.

Hitherto, a clay or a "synthetic colour developer" has been employed as the colour developer. However, since the clay is a natural product and so it is difficult to constantly obtain the clay of the same quality and the clay is less resistant to water, the employment of the synthetic colour developer has particularly been desired. In other words, the appearance of a pressure-sensitive recording paper with which an acceptable colour-developing property is constantly obtained under any environmental conditions while using the synthetic colour developer, has been hoped.

As the synthetic colour developer, a condensate of p-aralkylphenol and formaldehyde or a salt of phenylsalicylic acid, for instance, zinc salt is mentioned. Among the condensates of p-aralkylphenol and formaldehyde, that of p-phenylphenol and formaldehyde shown below is particularly preferable. The preferable molecular weight of the condensate is 300 to 800.

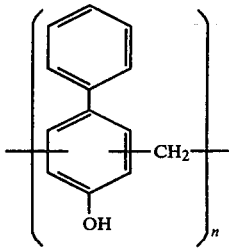

The object of the present invention is to provide a solvent which renders the pressure-sensitive recording paper a sufficient colour-developing property under the very cold environmental conditions by improving the solvent of the diisopropylnaphthalene or the partially hydrogenated terphenyl both of which fulfil the features required for the solvent for pressure-sensitive recording paper and are excellent even under hot and humid environmental conditions, and to make the use of the synthetic colour developer as the colour developer for pressure-sensitive recording paper. Another object of the present invention is to provide pressure-sensitive recording papers prepared by using the thus improved solvent.

The inventors of the present invention have found out that the sufficient rate of colour development is obtained even under very cold conditions and satisfactory utilization of the synthetic colour developer is possible by preparing a solvent while admixing 1-isopropylphenyl-2-phenylethane with diisopropylnaphthalene and/or partially hydrogenated terphenyl.

Accordingly, the present invention is characterized in that in the pressure-sensitive recording paper comprising the supporting paper sheet(s), the microcapsules of gelatine containing the solution of the colour former in the solvent and the colour developer, preferably the synthetic colour developer, the solvent is a mixture obtained by admixing 1-isopropylphenyl-2-phenylethane with each or both of the diisopropylnaphthalene and the partially hydrogenated terphenyl.

Although 1-isopropylphenyl-2-phenylethane according to the present invention is a known compound substantially odorless and colourless and its structural formula and physical properties are shown below.

Structural formula:

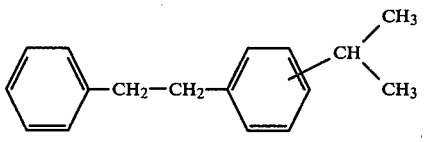

Boiling point: 313° to 315° C./760 mmHg

Specific gravity: 0.963 ($d_4^{15}$)

Kinematic viscosity: 4.5 cst at 100° F.

In addition, this compound can be synthesized, for instance, as follows:

(a) Benzene and 1,2-dichloroethane are condensed in the presence of aluminum chloride as a catalyst to obtain 1,2-diphenylethane. This 1,2-diphenylethane is subjected to propylation to form 1-isopropylphenyl-2-phenylethane, or (b) Benzene and cumen are brought into reaction with 1,2-dichloroethane in the presence of aluminum chloride as a catalyst to obtain 1-isopropylphenyl-2-phenylethane.

The partially hydrogenated terphenyl according to the invention is, as has been shown before, precisely disclosed in U.S. Pat. No. 3,968,301, and the present invention refers to and includes all the disclosures of the U.S. patent.

In the present invention, by admixing the 1-isopropylphenyl-2-phenylethane with the diisopropylnaphthalene and/or the partially hydrogenated terphenyl, the diisopropylnaphthalene or the partially hydrogenated terphenyl may be employed as a component of the excellent solvent even under the very cold environmental conditions. Further, the synthetic colour developer may be advantageously employed, which is a poor developer under the very cold conditions in the case of the solvent such as the diisopropylnaphthalene or the partially hydrogenated terphenyl.

The mixing ratio of the 1-isopropylphenyl-2-phenylethane in the mixed solvent according to the present invention is 20 to 50% by weight of the mixed solvent. In the case of less than 20% by weight, the required improvement of colour-developing property is not obtained, and although the colour-developing property is additively improved with the addition of the compound up to 50% by weight, no conspicuous change of the colour-developing property is observed in the case of addition of more than 50% by weight. The preferable mixture ratio of the 1-isopropylphenyl-2-phenylethane to the diisopropylnaphthalene is 20/80 to 50/50 by weight, and that of the 1-isopropylphenyl-2-phenylethane to the partially hydrogenated terphenyl is 40/50 to 50/50 by weight. In the case where the mixed solvent of the present invention comprises the 1-isopropylphenyl-2-phenylethane, the diisopropylnaphthalene and the partially hydrogenated terphenyl, the content of the 1-isopropylphenyl-2-phenylethane is 30 to 50% by weight and the remainder is a mixture of the diisopropylnaphthalene and the partially hydrogenated terphenyl of an optional mixture ratio.

In addition, as the colour former to be employed in the pressure-sensitive recording paper of the present invention, any colour former hitherto used is applicable without any restriction, and for instance, benzoyl leucomethylene blue, crystal violet lactone, malachite green lactone and derivatives of diaminofruorane can be mentioned.

As described above, the pressure-sensitive recording paper of the present invention exhibits the excellent colour-developing property, that is, the good colour density and the rapid rate of colour development, etc. under the very cold environmental conditions without losing the excellent property under the hot and humid conditions by the solvent of the diisopropylnaphthalene and the partially hydrogenated terphenyl. Under the very cold environmental conditions, the pressure-sensitive recording material exhibits just after recording a practically acceptable colour density which is at least 50% of the standard stipulated in the following Example, and on the other hand, not only clay but also any synthetic colour developer may be used for preparing the pressure-sensitive recording paper. Under the hot and humid conditions, the pressure-sensitive recording paper exhibits at least 60% of the standard stipulated in the following Example, which is practically acceptable.

The following is the more detail explanation of the present invention while referring to non-limitative examples.

EXAMPLES 1 TO 9 AND COMPARATIVE EXAMPLES 1 TO 12

Preparation of the Capsules

A solution obtained by dissolving 2.7 g of crystal violet lactone and 1.8 g of benzoylleucomethylene blue into 150 g of a mixed solvent shown in Table 1 was added to an aqueous solution of 30 g of gelatine in 270 g of water to prepare an emulsion.

Into the emulsion, a solution of 30 g of gum arabic dissolved in 270 g of water was added, and while stirring the mixture at a temperature of 50° C., 1000 ml of water was added to the mixture. Then, the pH of the whole mixture was reduced to 4.4 by adding an aqueous 50% solution of acetic acid to cause coacervation of the mixture, and after cooling the coacervated mixture to 10° C. to make the capsule membrane hardened, 20 ml of an aqueous 25% solution of glutaraldehyde was added to the mixture. Then the pH of the mixture was raised to 9 by the addition of an aqueous 10% sodium hydroxide solution to make the membrane harder thus completing the encapsulation.

Preparation of a Pressure-sensitive Recording Paper

A sheet of CB paper was prepared by coating the capsules obtained in the procedures as above on one side of a sheet of paper weighing 45 g/m$^2$ at a rate of 5 g of the dried material/m$^2$. A sheet of pressure-sensitive recording paper was prepared by combining the thus prepared sheet of CB paper and a sheet of CF paper prepared according to the conventional manner while using phenol resin.

Test on Colour Density under Hot and Humid Conditions

After leaving the thus prepared pressure-sensitive recording paper for 16 hours in a cabinet in which the temperature and relative humidity were kept constant at 40° C. and 90%, respectively, the paper was subjected to a calender to develop colour. Then the colour density ($D_h$) of the developed colour was measured by a reflection colour densitometer (manufactured by Macbeth & Co.). Such a measurement was also carried out on the pressure-sensitive recording paper prepared by the same procedures as above and kept at room temperature of 15° C. and relative humidity of 65% for 16 hours and then subjected to the same calender under the same conditions to develop colour. The thus measured colour density ($S_h$) was used as the standard, and the ratio of $D_h/S_h$ multiplied by 100(%) was used to evaluate the paper in the hot and humid environmental conditions. The paper having the ratio of more than 60% was evaluated to be excellent, which represents the practically acceptable colour density.

Test on Colour-developing Rate or Colour Density under Very Cold Conditions

The pressure-sensitive recording paper prepared by the same procedures was subjected to the calender in a room kept at a temperature of −5° C. and the colour density of the thus treated pressure-sensitive recording paper was measured two times, namely at 30 sec and 24 hours after calendering i.e. developing. The thus obtained values of colour density were named $D_c$ and $S_c$, respectively, the latter was used as the standard. The ratio of $D_c/S_c$ multiplied by 100 (%) was used to evaluate the paper in the very cold conditions. The paper having the ratio of more than 50% was evaluated to be excellent, which represents the practically acceptable colour density.

The values of $D_h/S_h \times 100(\%)$ and $D_c/S_c \times 100(\%)$ of each pressure-sensitive recording paper prepared in Examples 1 to 9 and Comparative Examples 1 to 12 are shown in Table 1 and 2, those values in Table 2 being the data of the papers prepared by using the publicly known solvents and mixed solvents.

TABLE 1

| | Solvent (proportion of mixing, % by weight) | | | Colour Density Ratio (%) | |
|---|---|---|---|---|---|
| | A | B | C | under hot and humid conditions | under very cold conditions |
| Example | | | | | |
| 1 | 20 | 80 | 0 | 67 | 51 |
| 2 | 30 | 70 | 0 | 68 | 58 |
| 3 | 40 | 60 | 0 | 69 | 63 |
| 4 | 50 | 50 | 0 | 70 | 66 |
| 5 | 40 | 0 | 60 | 72 | 50 |
| 6 | 50 | 0 | 50 | 72 | 58 |
| 7 | 30 | 35 | 35 | 70 | 50 |
| 8 | 40 | 30 | 30 | 70 | 57 |
| 9 | 50 | 25 | 25 | 71 | 62 |
| Comparative example | | | | | |
| 1 | 10 | 90 | 0 | 66 | 35 |
| 2 | 30 | 0 | 70 | 72 | 37 |
| 3 | 20 | 0 | 80 | 72 | 19 |
| 4 | 10 | 0 | 90 | 72 | 3 |
| 5 | 20 | 40 | 40 | 69 | 36 |
| 6 | 10 | 45 | 45 | 69 | 15 |

Note:
A = 1-isopropylphenyl-2-phenylethane,
B = diisopropylnaphthalene and
C = partially hydrogenated terphenyl

TABLE 2

| Comparative Example | Solvent composition | Colour Density Ratio (%) under hot and humid conditions | Colour Density Ratio (%) under very cold conditions |
|---|---|---|---|
| 7 | diisopropylnaphthalene (100%) | 65 | 12 |
| 8 | partially hydrogenated terphenyl (100%) | 72 | less than 3 |
| 9 | diisopropylnaphthalene (50%) phenyl-xylylethane (50%) | 28 | 39 |
| 10 | partially hydrogenated terphenyl (50%) isopropylbiphenyl (50%) | 30 | 38 |
| 11 | phenyl-xylylethane (100%) | 14 | 47 |
| 12 | isopropylbiphenyl (100%) | 11 | 56 |

What is claimed is:

1. A pressure-sensitive recording material comprising:
   (a) a supporting sheet,
   (b) microcapsules applied to said supporting sheet, said microcapsules containing a color former dissolved in a solvent comprising a mixture of 1-isopropylphenyl-2-phenylethane with diisopropylnaphthalene and/or partially hydrogenated terphenyl, the content of 1-isopropyl-2-phenylethane in said mixture being 20 to 50% by weight, and
   (c) a synthetic color developer thereon comprising a condensate of p-aralkylphenol and formaldehyde or a salt of phenylsalicylic acid.

2. A pressure-sensitive recording material according to claim 1, wherein said solvent contains 20 to 50% by weight of 1-isopropylphenyl-2-phenylethane and 80 to 50% by weight of diisopropylnaphthalene.

3. A pressure-sensitive recording material according to claim 1, wherein said solvent contains 40 to 50% by weight of 1-isopropylphenyl-2-phenylethane and 60 to 50% by weight of partially hydrogenated terphenyl.

4. A pressure-sensitive recording material according to claim 1, wherein said solvent contains 30 to 50% by weight of 1-isopropylphenyl-2-phenylethane and 70 to 50% by weight of a mixture of diisopropylnaphthalene and partially hydrogenated terphenyl.

5. A pressure-sensitive recording material according to claim 1, wherein said synthetic colour developer is a condensate of p-aralkylphenol and formaldehyde.

6. A pressure-sensitive recording material according to claim 5, wherein said p-aralkylphenol is p-phenylphenol.

7. A microcapsule for a pressure-sensitive recording material, which contains a colour former and a solvent comprising a mixture of 1-isopropyl-2-phenylethane with diisopropylnaphthalene and/or partially hydrogenated terphenyl in a gelatine wall, the content of 1-isopropyl-2-phenylethane in said mixture being 20 to 50% by weight.

* * * * *